US009850899B2

(12) United States Patent
Chang

(10) Patent No.: US 9,850,899 B2
(45) Date of Patent: Dec. 26, 2017

(54) BRUSHLESS DC COMPRESSOR IN MICRO-MINIATURE FORM

(71) Applicant: Ching-Ko Chang, Tainan (TW)

(72) Inventor: Ching-Ko Chang, Tainan (TW)

( * ) Notice: Subject to any disclaimer, the term of this patent is extended or adjusted under 35 U.S.C. 154(b) by 262 days.

(21) Appl. No.: 14/702,869

(22) Filed: May 4, 2015

(65) Prior Publication Data

US 2016/0327041 A1 Nov. 10, 2016

(51) Int. Cl.

| | |
|---|---|
| ***F04C 15/00*** | (2006.01) |
| ***F04C 23/00*** | (2006.01) |
| ***F04C 18/356*** | (2006.01) |
| *F04C 29/00* | (2006.01) |

(52) U.S. Cl.

CPC ..... *F04C 15/0061* (2013.01); *F04C 18/3564* (2013.01); *F04C 23/008* (2013.01); *F04C 29/0085* (2013.01); *F04C 29/005* (2013.01)

(58) Field of Classification Search

CPC ..... F04D 13/06
USPC ..... 417/410.1
See application file for complete search history.

(56) References Cited

U.S. PATENT DOCUMENTS

2005/0201884 A1* 9/2005 Dreiman ..... F04C 18/321 418/173

* cited by examiner

*Primary Examiner* — Devon Kramer
*Assistant Examiner* — Kenneth J Hansen
(74) *Attorney, Agent, or Firm* — Rosenberg, Klein & Lee

(57) ABSTRACT

A brushless DC compressor comprising a casing, a brushless DC motor, a compression device, and a driving mechanism. The casing has a left room, a right room adjacent the left room, and a lower room. The brushless DC motor is disposed in the left room, and the compression device is disposed in the right room. The driving mechanism is disposed in the lower room, including a driving gear engaging a rotor of the brushless DC motor, a driven gear engaging a hollow shaft of the compression device and driven by the driving gear; whereby refrigerant flows into a compression space of the compression device, rotating the rotor by the stator and driving the driving gear, the driven gear, then the compression device; then being discharged from a refrigerant discharge hole and an axial groove, to form a brushless DC compressor with stronger torque and greater compression efficiency.

9 Claims, 7 Drawing Sheets

200

BRUSHLESS DC COMPRESSOR IN MICRO-MINIATURE FORM

BACKGROUND OF THE INVENTION

1. Field of the Invention

The present invention relates to a compressor, particularly to one that is operated by a brushless DC motor, abreast of a compression device, achieving a brushless DC compressor in micro-miniature form with stronger torque and greater efficiency in compression with the speed-change function of a driving mechanism.

2. Description of the Related Art

Conventional air-conditioners usually have a reciprocating compressor or one with rolling piston to operate with refrigerant. Such compressors have large volume and would distribute heat; therefore they are more suitable to be installed outdoors instead of indoors or in small space.

The air-conditioning compressors used in cars are mostly driven by the engines, but when the engines are turned off, the air-conditioning compressors would not be able to operate, causing the temperature in the cars rising and the people sitting in would not be able to stand the hot. On the other hand, if the engine is kept running to operate the air-conditioning compressors for the people in the car when the car is parked, it would be a waste of energy and the carbon dioxide emission would cause environmental pollution as well. Also, idling for over certain period would break the law.

There are some other air-conditioning compressors have a DC motor to drive the motor to operate the compression and recycling of the refrigerant to cool down the air in the cars. However, such structure has a design of eccentric shaft in the DC motors which would cause the unbalanced driving force of the motors, producing more shakings and louder noises during the operation. Also, there are problems of the sparks due to the operation of the brushes and the electromagnetic interference when the DC motors with brushes are operating. Besides, most DC compressors have the axis of the motor sharing the same axis with the operation axis of the compressor. Since the compressor and the motor both have high rotation speed, the torque would be too weak and the machine would not be able to change the speed, resulting in poor compression efficiency.

With the problems disclosed above, there is still room for improvements.

SUMMARY OF THE INVENTION

A primary object of the present invention is to provide a brushless DC compressor in micro-miniature form that has a small volume for indoors or small space installment.

Another object of the present invention is to provide a brushless DC compressor in micro-miniature form that has a driving mechanism with speed-change function to achieve stronger torque and greater efficiency in compression.

Yet another object of the present invention is to provide a brushless DC compressor in micro-miniature form that is stable in operation with less shaking and lower noises.

To achieve the objects mentioned above, the present invention comprises a casing which is hollow and has openings at both sides, including a left room, a right room, and a lower room; a first tubular passage and a first shaft hole being arranged through the lower room and the left room; a second tubular passage and a second shaft hole being arranged through the lower room and the right room; a brushless DC motor disposed in the left room, including a stator with a surrounding coil group having a lead and an axial groove, and a rotor to be engaged and rotate in the stator having a permanent magnet arranged thereon, an upper shaft at an end and a lower shaft at the other end and having the lower shaft stretching into the lower room; a compression device disposed in the right room, including a compression space, a refrigerant inflow hole, a body with a radial trench, and a hollow shaft with a rotary element for eccentrically rotation in the compression space; a movable block disposed in the radial trench for the spring to push for displacement; a radial refrigerant intake hole arranged on the inner side of the compression space to connect to the refrigerant inflow hole; a refrigerant discharge hole arranged on the side wall of the redial trench; a lower cover fixed at the bottom of the body, having a first axial hole connecting the refrigerant discharge hole of the compression space and being pressed by a first oblong depression with a free end, and a fourth shaft hole to be engaged through by the second end of the hollow shaft which then stretches into the lower room; a driving mechanism disposed in the lower room of the casing, including a driver engaged around the end of the lower shaft, and a driven element engaged around the second end of the hollow shaft, where the driven element would be driven to rotate by the driver; a top cover arranged on the top of the casing for the rotor of the brushless DC motor to be disposed in the left room, and for the compression device to be disposed in the right room; a set of electrical connector arranged through the top cover and connected to the lead of the brushless DC motor with the inner end thereof; a bottom cover arranged at the bottom of the casing; a refrigerant intake tube connecting the refrigerant intake hole through the entry hole of the top cover; and a refrigerant discharge tube connecting the exit hole of the top cover;

whereby the rotor would be driven by the magnetic force from the stator when refrigerant flows into the compression space via the refrigerant intake hole, driving the driver and the driven element of the driving mechanism, and then the rotary element to rotate eccentrically, to force the refrigerant in the compression space to flow out via the refrigerant discharge hole on the radial trench and push the free end of the first elastic oblong piece with high pressure when the refrigerant flows through the first axial hole of the lower cover so that the refrigerant would flow through the lower room and the axial groove of the stator, and then be discharged to the inner wall of the top cover and flow out through the refrigerant discharge tube, so as to form a brushless DC compressor in micro-miniature form.

Furthermore, the driver of the driving mechanism is a driving gear and the driven element of the driving mechanism is a driven gear, where the cogs of the driving gear are less than the one of the driven gear; a set of speed-change gears is further arranged between the driving gear and the driven gear and has a larger gear with more cogs and a smaller gear with less cogs, where the larger gear is meshing with the driving gear and the smaller gear is meshing with the driven gear. And the driving gear, driven gear, larger gear, and the smaller gear are all helical gears.

In addition, the hollow shaft has a plurality of small holes radially arranged thereon and a helical element arranged therein. The first elastic oblong piece has the inner end thereof fixed with an end of a first fixed oblong piece by a screw, so as to define the space for the free end of the first elastic oblong piece to spring.

The body of the present invention further has an axially through bypass hole arranged thereon, a second oblong depression arranged on the upper cover with an end having a through second axial hole connecting the refrigerant discharge hole of the compression space, a second elastic oblong piece and a second fixed oblong piece with an inner end of both being fixed in the second oblong depression by a screw and the free end thereof pressing the second axial hole to spring; a fixing cover fixed above the upper cover, allowing the refrigerant from the second axial hole to flow through the bypass hole of the body and then flow into the lower room.

The present invention further includes a housing for placing the brushless DC compressor in micro-miniature form, a lid arranged on the top of the housing with an electrode to be connected to the electrical connector on the top cover, and two openings for the refrigerant intake tube and the refrigerant discharge tube to stretch out the lid; and the housing has liquids and a water absorbing buffer filled therein, as so to form a sealed brushless DC compressor.

The housing further includes a base arranged at the bottom thereof and a plurality of buffer cushions arranged on the base. And the liquids is made of coolant, oil, water, or any of the combination; and the water absorbing buffer is made of sponges, clothes, fibers or any of the combination.

With structures disclosed above, the present invention has a smaller volume for application in indoors and small space. Also, with the abreast brushless DC motor and compression device, the present invention has stronger torque and greater efficiency in compression by the speed-change function of the driving device. Further, the present invention has buffer filled inside the sealed housing, keeping a stable status in operation with less shaking and lower noises, so as to achieve greater efficiency with power saving function.

DETAILED DESCRIPTION OF THE PREFERRED EMBODIMENT

Figure 1:
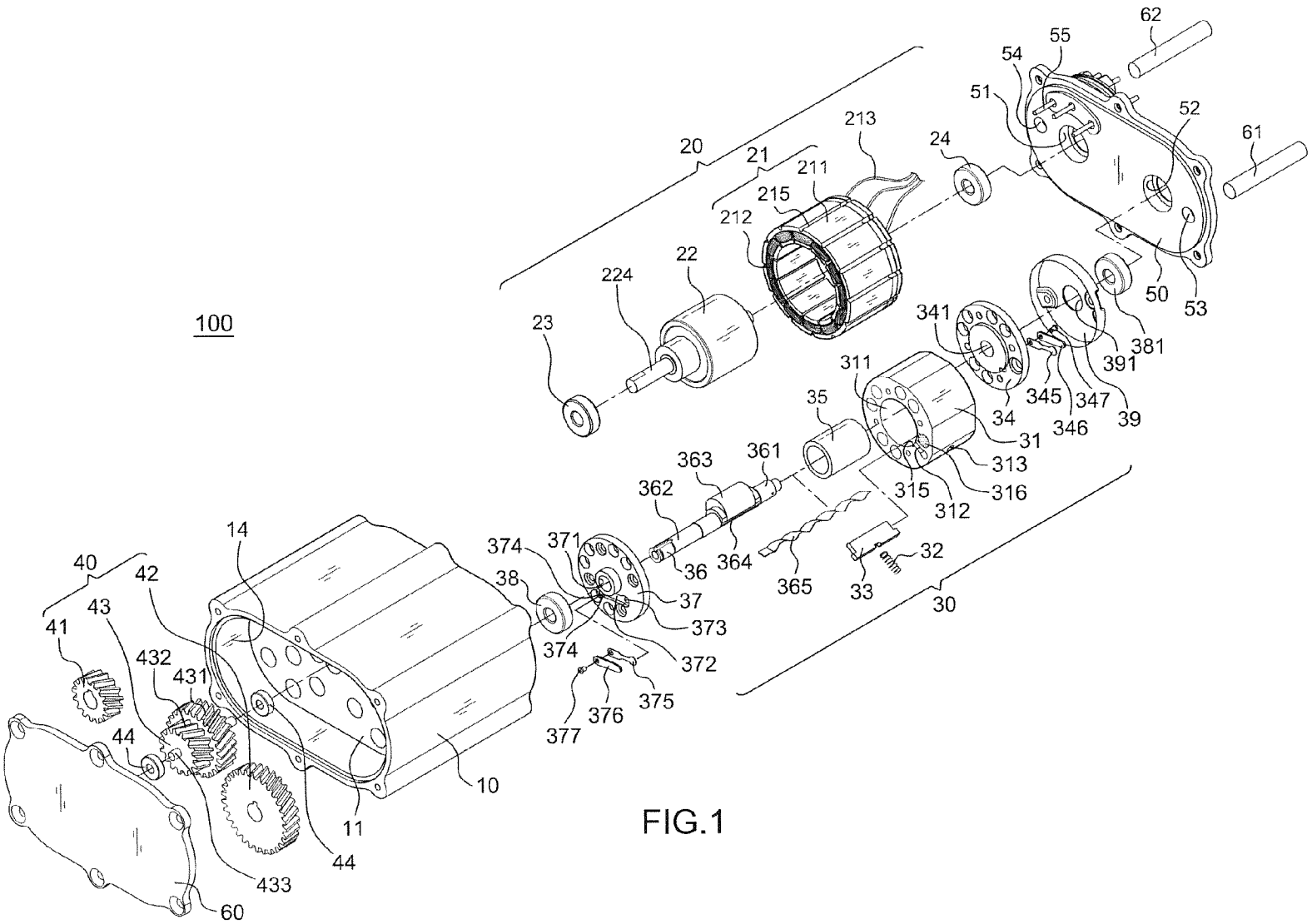
FIG. 1 is an exploded view of the present invention in a preferred embodiment.
Figure 2:
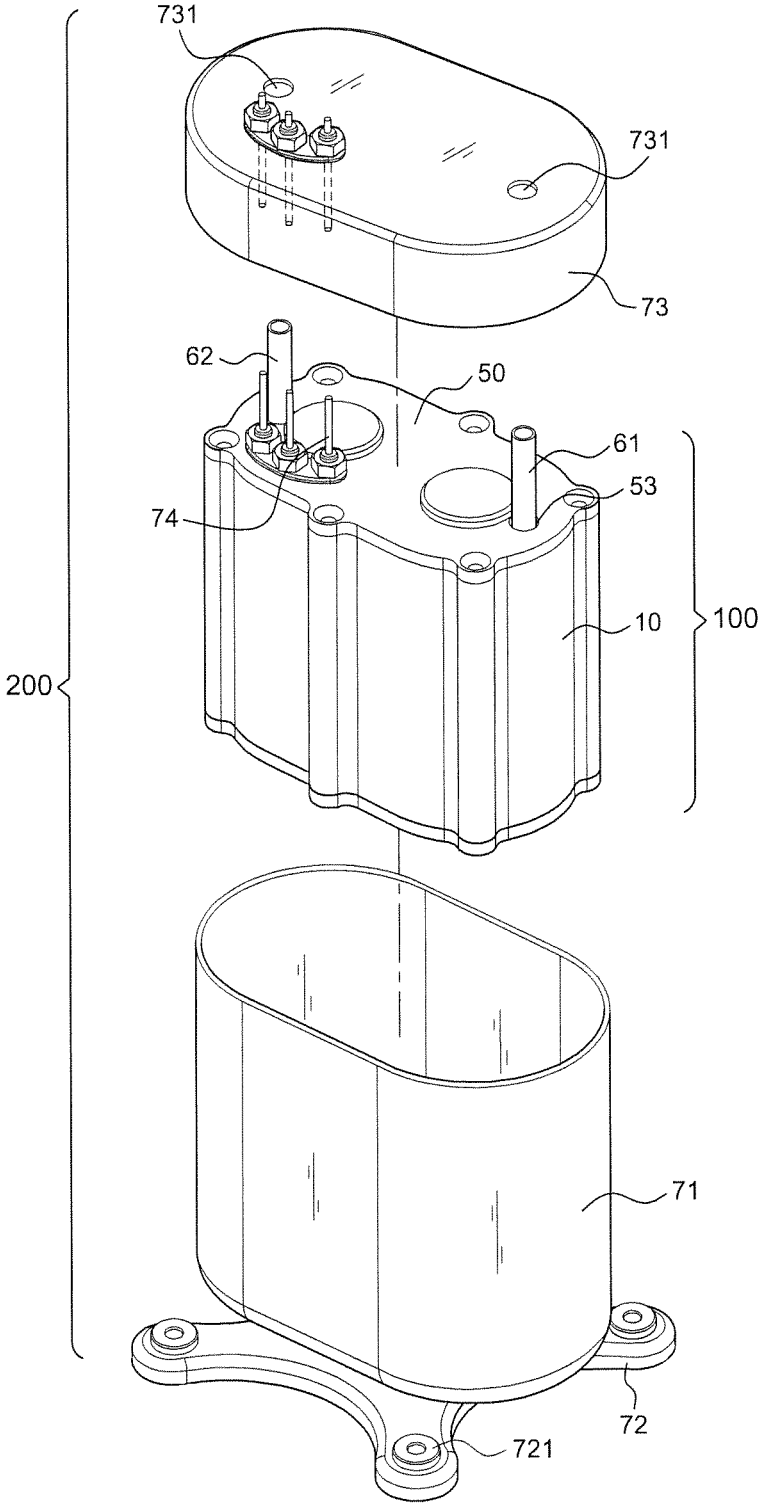
FIG. 2 is an exploded view of a sealed brushless DC compressor of the present invention in a preferred embodiment.
Figure 3:
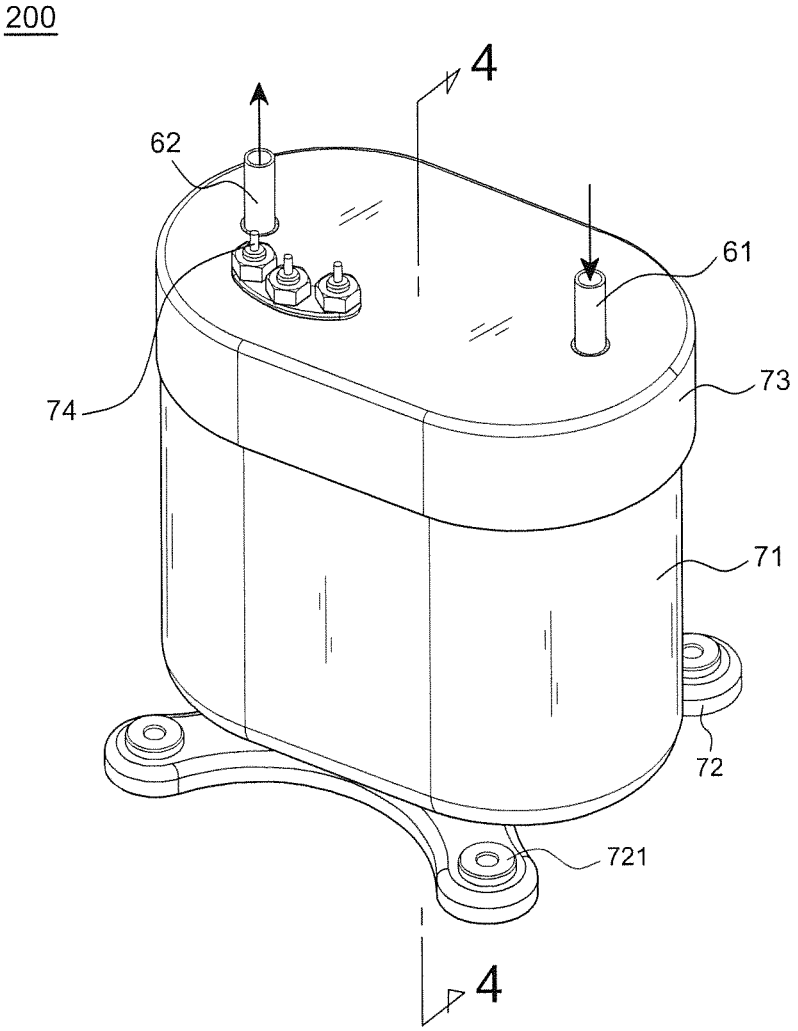
FIG. 3 is a perspective view of a sealed brushless DC compressor of the present invention in a preferred embodiment.
Figure 4:
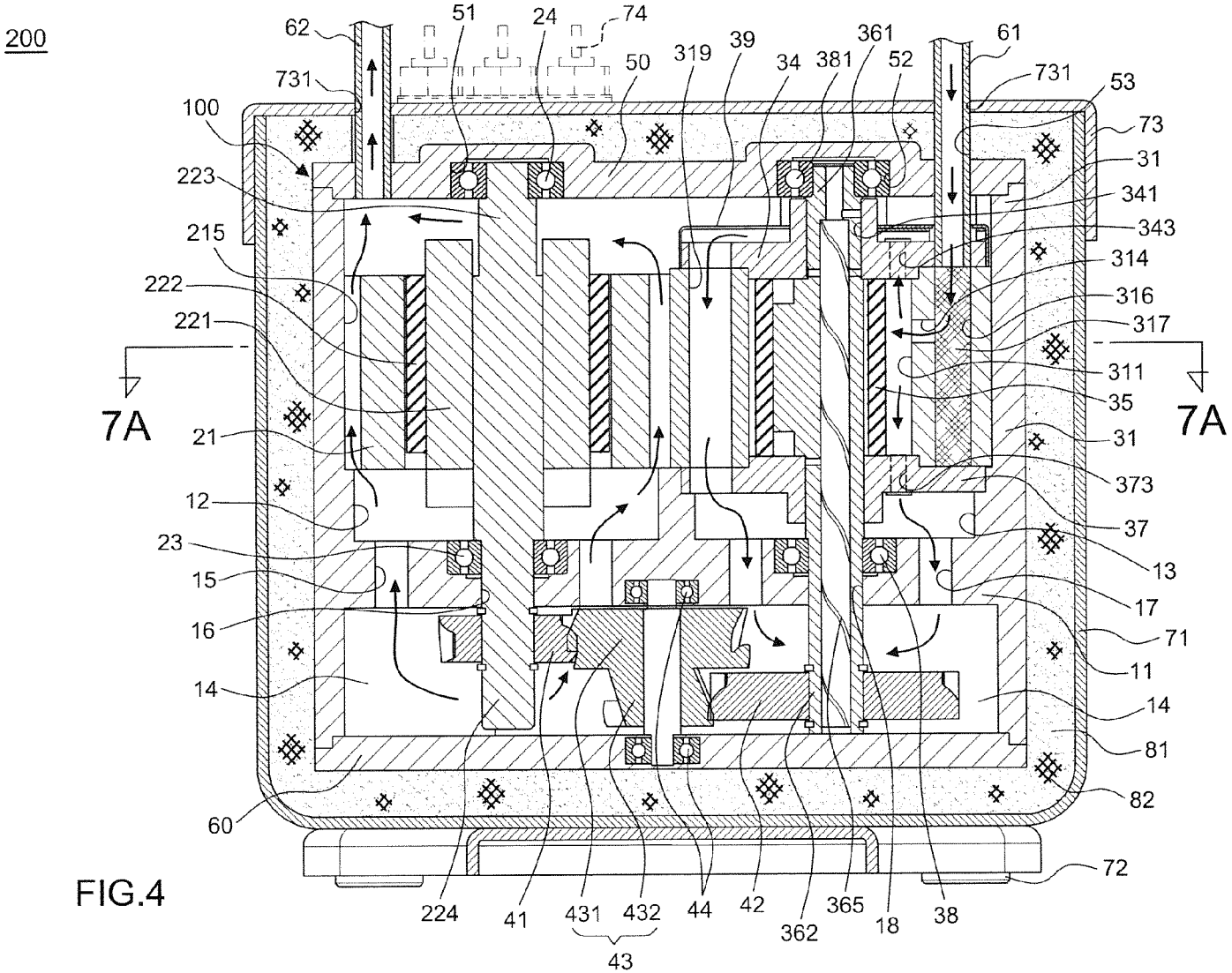
FIG. 4 is a sectional view along ling 4-4 in FIG. 3.

Referring to FIGS. 1 and 4, a preferred embodiment of the present invention mainly comprises a casing 10, a top cover 50, a bottom cover 60, a brushless DC motor 20, a compression device 30, a driving mechanism 40, a set of electrical connector 55, a refrigerant intake tube 61, and a refrigerant discharge tube 62.

The casing 10 is a hollow tube with openings at both sides, having a divider board 11 therein to define a left room 12, a right room 13, and a lower room 14. The left room 12 has a first tubular passage 15 and a first shaft hole 16 connecting the lower room 14. The right room 13 has a second tubular passage 17 and a second shaft hole 18 connecting the lower room 14.

The top cover 50 is arranged on the top of the casing 10 to seal the left and the right room 12, 13 and the bottom cover 60 is arranged at the bottom of the casing 10 to seal the lower room 14.

The DC brushless motor 20 includes a stator 21 and a rotor 22. The stator 21 is fixed inside the left room 12 of the casing 10, formed by an annular body 211 and a surrounding coil group 212 with an axial groove 215 arranged on the stator and the surrounding coil group 212 having a lead 213 for connecting with the external DC circuit. The rotor 22 is formed by a column 221 and a permanent magnet 222 arranged on the column 221 with the column 221 having an upper shaft 223 and a lower shaft 224 sharing the same axis. The upper shaft 223 is rotating in a first positioning hole 51 on the top cover 50 with a third bearing 23 engaging around and the lower shaft 224 has a first bearing 23 engaging around and is stretching through the first shaft hole 16 into the lower room 14 for the rotor 22 to be engaged and rotate inside the stator 21.

Figure 6:
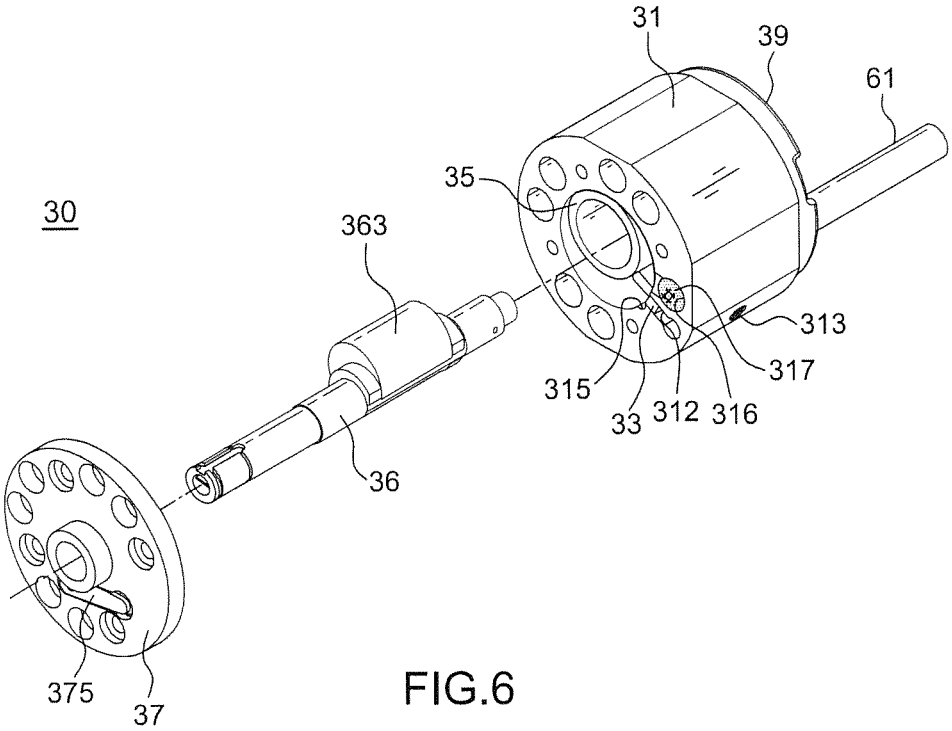
FIG. 6 is a an exploded view of a compression device of the present invention in a preferred embodiment.
Figure 6A:
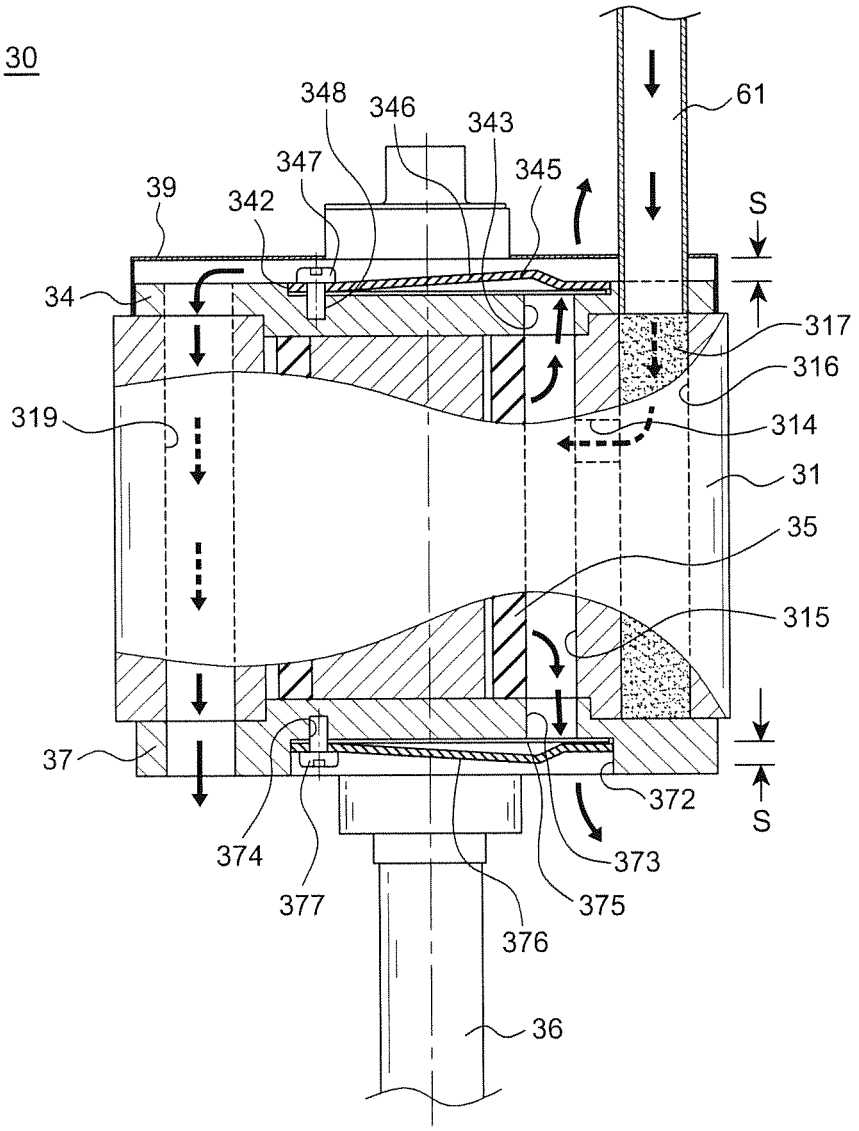
FIG. 6A is a schematic diagram of the flow of the refrigerant in the compression device.

Referring to FIG. 6A, the compression device 30 includes a body 31, a spring 32, a movable block 33, a refrigerant discharge hole 315, an upper cover 34, a second elastic oblong piece 345, a rotary element 35, a hollow shaft 36, a lower cover 37, and a first elastic oblong piece 375.

The body 31 is disposed inside the right room 13 of the casing 10 with the middle thereof having a round compression space 311 for a through refrigerant inflow hole 31 6, an axial bypass hole 319, and a radial trench 312 to be arranged on the inner wall of the compression space 311. The radial trench 312 is connecting the compression space 311 on the inner side and has a radial hole 313 on the outer wall. The compression space 311 further has a radial refrigerant intake hole 314 arranged on the inner wall to connect the refrigerant inflow hole 316. The spring 32 is disposed in the radial hole 313. The movable block 33 is disposed inside the radial trench 312 for the spring 32 to push for displacement. The refrigerant discharge hole 315 is arranged on the inner side of the radial trench 312. The upper cover 34 is fixed on the top of the body 31, having a third shaft hole 341 arranged at the center which has a shorter diameter than the one of the compression space 311; in this embodiment, the upper cover 34 further has a second oblong depression 342 arranged thereon with an end having a through second axial hole 343 connecting the refrigerant discharge hole 315 of the compression space 311, and the other end having a second screw hole. The second elastic oblong piece 345 is fixed in the second oblong depression 342 by a screw 347 that fixes an end thereof in the second screw hole, and has a second fixed hole 348 arranged on the other farther end from the second axial hole 343 to be able to spring as a free end to define a space for springing. In this embodiment, the present invention further includes a fixing cover 39 fixed above the upper cover 34 for defining the space for the second elastic oblong piece 345 to spring, allowing the refrigerant from the second axial hole 343 to flow through the bypass hole 319 of the body 31 and then flow into the lower room 14 below the lower cover 37.

The rotary element 35 has a shorter diameter than the one of the compression space 311 to be disposed inside for rotation. The hollow shaft 36 has a first end 361 and a second end 362, and an eccentric convexity body 363 is formed in the middle thereof to be engaged through the rotary element 35. The first end 361 is engaged through the third shaft hole 341 and rotates with a fifth bearing 381 in the second positioning hole 52 on the top cover 50. In the embodiment, the hollow shaft 36 has a plurality of small holes 364 radially arranged thereon and a helical element 365 arranged therein.

The lower cover 37 is fixed at the bottom of the body 31, having a fourth shaft hole 371 sharing the same axis as the third shaft hole 341 for the second end 362 of the hollow shaft 36 to stretch through the fourth shaft hole 371 and the second shaft hole 18, into the lower room 14; a second bearing is arranged around the hollow shaft 36 to fix the position in the middle of the body 31, and the eccentric convexity body 363 at the middle of the hollow shaft 36 is able to rotate the rotary element 35 eccentrically in the compression space 311. Furthermore, a first oblong depression 372 is arranged on the lower part of the lower cover 37 with an end thereof having a first axial hole 373 connecting the refrigerant discharge hole 315 of the compression space 311 and the other end having a first screw hole 374 arranged thereon. Referring to FIG. 6, the first elastic oblong piece 375 is fixed in the first oblong depression 372 with an end farther from the first axial hole 373 being screwed in the first screw hole 374 to fix the position in the first oblong depression 372, allowing the other end to elastically press the first axial hole 373 as a free end and being able to spring. In this embodiment, the first elastic oblong piece 375 has the inner end thereof fixed with an end of a first fixed oblong piece 376 by screwing, so as to define the space for the other free end to spring.

The driving mechanism 40 is disposed in the lower room 14 of the casing 10, including a driver 41 engaged around the end of the lower shaft 224, and a driven element 42 engaged around the second end 362 of the hollow shaft 36; the driven element 42 would actuate when driven by the driver 41. In this embodiment, the driver 41 is a driving gear and the driven element 42 is a driven gear, and a set of speed-change gears 43 is further arranged between the driving gear 41 and the driven gear 42 with a larger gear 431 having more cogs, a smaller gear 432 having less cogs, and a gear shaft 433 having an end thereof fixed by a fourth bearing 44 to rotate in the lower room 14 of the casing 10. Besides, the cogs of the driving gear 41 are much less than the one of the driven gear 42 so that the hollow shaft 36 of the compression device 30 has stronger torque for operation, and the driving gear 41 is meshing with the larger gear 431 and the driven gear 42 is meshing with the smaller gear 432. Also, for greater operation efficiency, the driving gear 41, driven gear 42, larger gear 431, and the smaller gear 432 are all helical gears.

The top cover 50 also has an entry hole 53 and an exit hole 54 arranged thereon; the electrical connector set 55 is arranged through the top cover 50 and the inner end thereof is connected to the lead 213 of the brushless DC motor 20. The refrigerant intake tube 61 is connecting the refrigerant inflow hole 316 through the entry hole 53 of the top cover 50. The refrigerant discharge tube 62 is connecting the exit hole 54 of the top cover 50;

whereby the rotor 22 would be driven by the magnetic force from the stator 21 when refrigerant flows into the compression space 311 via the refrigerant inflow hole 316 and the refrigerant intake hole 314, driving the driving gear 41, the speed-change gears set 43 and the driven gear 42 of the driving mechanism 40 to rotate the rotary element 35 eccentrically and force the refrigerant in the compression space 311 to flow out via the refrigerant discharge hole 315 and then flow into the first axial hole 373 on the lower cover 37 or the second axial hole 343 on the upper cover 34, either would push the free end of the first elastic oblong piece 375 or the second elastic oblong piece 345 with high pressure, resulting the refrigerant eventually flowing below the lower cover 37 and being discharged to the inner wall of the top cover 50 via the second tubular passage 17, the lower room 14, the first tubular passage 15 and the axial groove 215 of the stator 21; then the refrigerant would flow out from the refrigerant discharge tube 62, forming the present invention as a brushless DC compressor in micro-miniature form 100.

In another applicable embodiment, the present invention could be a sealed brushless DC compressor 200. Referring to FIG. 4, the sealed brushless DC compressor 200 includes a housing 71 for placing the brushless DC compressor in micro-miniature form 100, a lid 73, and two openings 731. The housing has a base 72 arranged at the bottom thereof and a plurality of buffer cushions 721 arranged on the base. The lid 73 is arranged on the top of the housing 71 with an electrode 74 to be connected to the electrical connector 55 on the top cover 50. The openings 731 allow the refrigerant intake tube 61 and the refrigerant discharge tube 62 to stretch out the lid 73 and allow the housing 71 to have liquids 81 and a water absorbing buffer 82 filled therein, so as to form a sealed brushless DC compressor 200.

In this embodiment, the liquids 81 is made of coolant, oil, water, of any of the combination, and the water absorbing buffer 82 is made of sponges, clothes, fibers or any of the combination. In addition, the sealed brushless DC compressor 200 not only has the features of the brushless DC compressor in micro-miniature form 100, but also has lower noises, making it suitable for the design of air-conditioner indoors.

With the structure disclosed above, the present invention has the features and function as described in the following.

1. The abreast brushless DC motor 20 and the compression device 30 can obtain the compressed torque by the design of the driving gear 41, the driven gear 42, the larger gear 431, and the small gear 432 of the driving mechanism 40. In other words, the cogs of the mentioned gears can be adjusted to obtain the compressed torque needed.

2. The hollow shaft 36 has a plurality of small holes 364 radially arranged thereon and a helical element 365 arranged therein. As shown in FIG. 4, when the hollow shaft 36 is rotating, the helical element 365 would draw in the liquid refrigerant from the lower room 14, and the refrigerant would flow through the third shaft hole 341, the fourth shaft hole 371 and the rotary element 35 via the small holes 364, functioning as a lubrication and coolant to prevent the entire machine from overheating.

3. The refrigerant inflow hole 316 can be filled with filtering materials 317. As shown in FIG. 4, before the refrigerant enters into the compression space 311 from the refrigerant intake tube 61, the impurities can be filtered by the filtering materials 317, to make sure the components in the compression space 311 would not be damaged and therefore extend the durability of the device.

Figure 5:
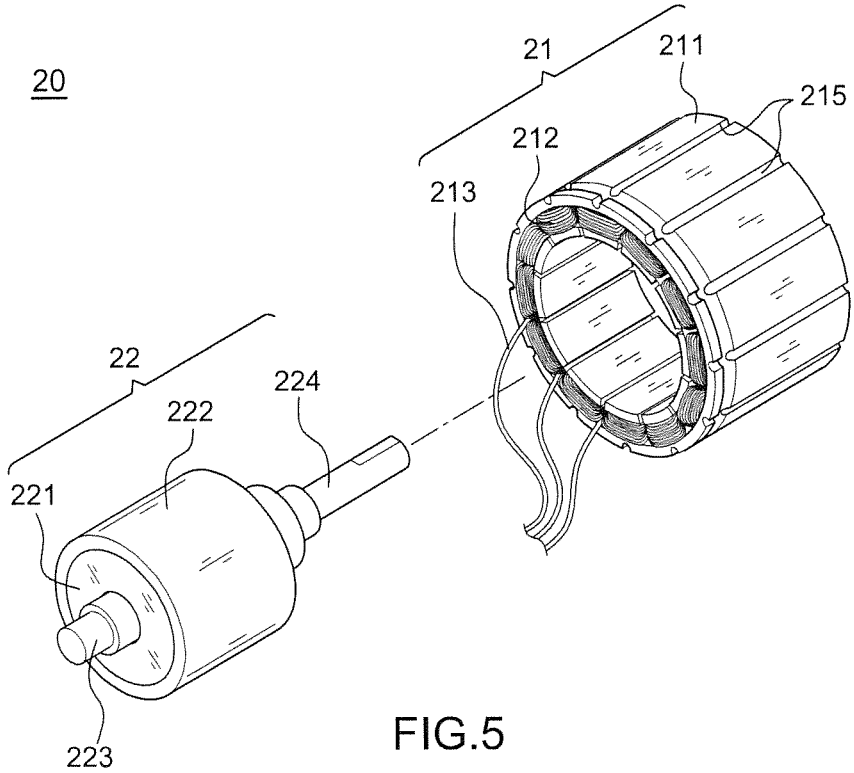
FIG. 5 is an exploded view of a brushless DC motor of the present invention in a preferred embodiment.

4. The brushless DC motor 20 of the present invention includes a stator 21 with a surrounding coil group 212 and a rotor 22 with a permanent magnet 222. As shown in FIG. 5, the surrounding coil group 212 has a lead 213 for connecting with external DC circuit by the electrical connector 55 on the top cover 50. When connected to the external DC circuit, the stator 21 would drive the rotor 22 therein to rotate. Since there is no carbon brushes fractioning with the rotor 22, the brushless DC motor 20 is power saving and quiet in operation.

Figure 7A:
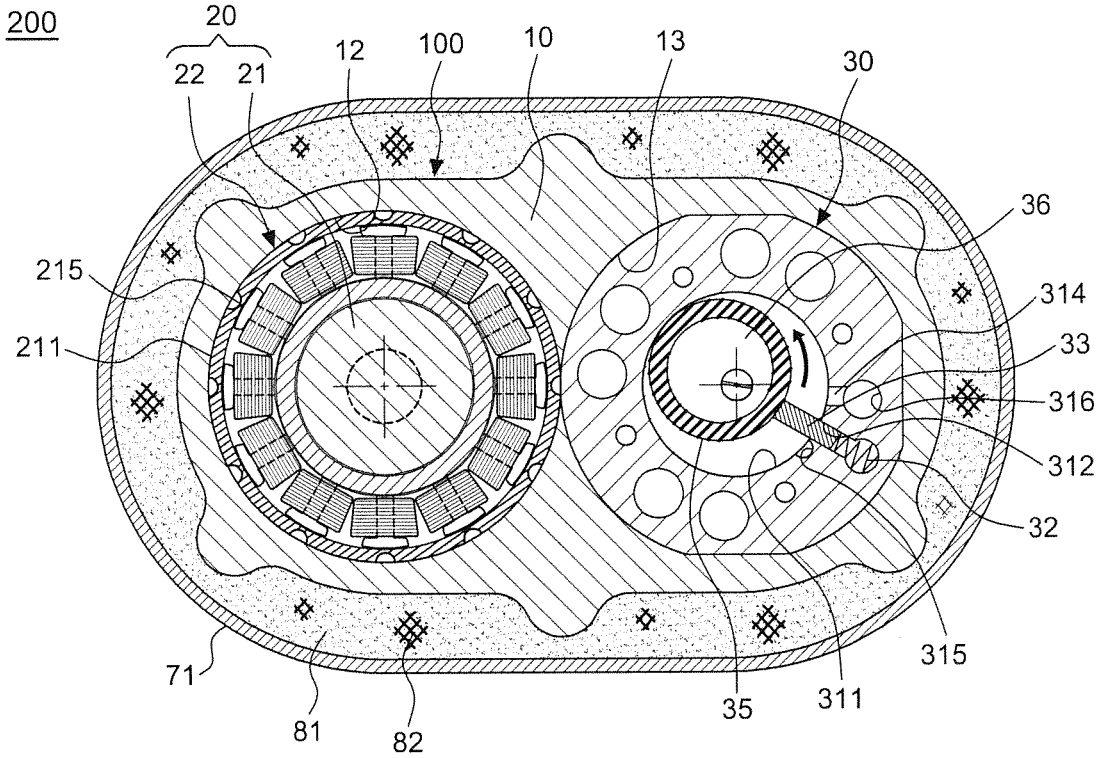
FIG. 7A is an exploded view along line 7A-7A in FIG. 4, illustrating the operation of the present invention in a preferred embodiment.
Figure 7B:
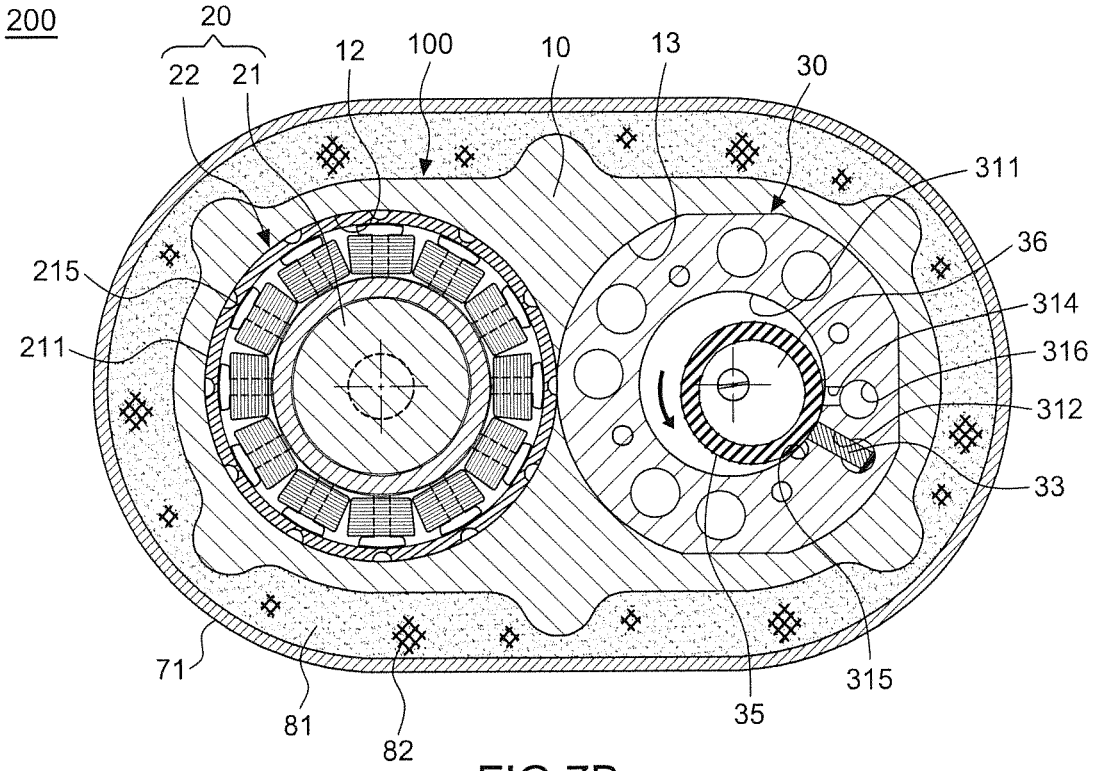
FIG. 7B is an exploded view illustrating another operation of the present invention in a preferred embodiment.

5. The moving block 33 is disposed in the radial trench 312 for the spring 32 to push for radial displacement. As shown in FIGS. 7A and 7B, when the hollow shaft 36 drives the rotary element 35 to eccentrically rotate in the compression space 311, the place of the moving block 33 would be adjusted in accordance with the displacement of the rotary element 35 and the pushing of the spring 32. FIG. 7A, illustrates the moving block 33 being pushed to the extreme by the spring 32; the refrigerant is drawn into the compression space 311 via the refrigerant intake hole 314. FIG. 7B illustrates the moving block 33 being pushed to the extreme by the rotary element 36 due to the rotation of the hollow shaft 36; the refrigerant in the compression space 311 is forced to flow out from the refrigerant discharge hole 315 by the compression of the rotary element 36. Further referring to FIG. 6A, the refrigerant would flow through the first axial hole 373 on the lower cover 37 and push the free end of the first elastic oblong piece 375 with high pressure, then flow out from the compression device 30. In this embodiment, the first elastic oblong piece 375 has the inner end thereof fixed with an end of a first fixed oblong piece 376 by screwing, so as to define the space S for the free end of the first elastic oblong piece 375 to spring, allowing the high-pressured refrigerant to be discharged and preventing from elastic fatigue and deformation due to long-term operation. In the embodiment, the refrigerant can also flow through the second axial hole 343 of the upper cover 34 from the refrigerant discharge hole 315 and push the free end of the second elastic oblong piece 345 to enter through the lower cover 37 through the bypass hole 319 of the body 32; and the second elastic oblong piece 345 also has the inner end thereof fixed with an end of a second fixed oblong piece 346 by a screw 347, so as to define the space S for the free end of the second elastic oblong piece 345 to spring, In summary, the present invention has a smaller volume to be applied in the design in indoors or small space, and it has stronger torque and greater compression efficiency with the speed-change function of the driving mechanism 40 by the abreast arrangement of the brushless DC motor 20 and the compression device 30. Also, the present invention has liquids 81 and water absorbing buffer 82 to be filled in the housing 71 to completely seal the device, providing a stable machine with less shaking and lower noises to achieve greater efficiency with power saving function.

Although particular embodiments of the invention have been described in detail for purposes of illustration, various modifications and enhancements may be made without departing from the spirit and scope of the invention. Accordingly, the invention is not to be limited except by the appended claims.

What is claimed is:

1. A brushless DC compressor, comprising:

a hollow casing having openings at a pair of opposing sides, the casing including a divider board therein to define a first room, a second room, and a lower room, a first tubular passage arranged through the lower room and the first room, and a second tubular passage arranged through the lower room and the second room;

a DC brushless motor fixed inside the first room of the casing including a stator and a rotor; the stator being formed by an annular body and a surrounding coil group with an axial groove arranged about the annular body, and the surrounding coil group having a lead; the rotor formed by a column and a permanent magnet arranged on the column with the column having a lower shaft extending into the lower room, the rotor rotatably disposed inside the stator;

a compression device including a body arranged inside the second room of the casing, the body having an annular compression space at a central portion thereof for a through refrigerant inflow hole and a radial trench to be arranged on an inner wall of the compression space and for a radial hole to be arranged on an outer wall of the compression space, and a radial refrigerant intake hole arranged on the inner wall of the compression space to connect to the refrigerant inflow hole; a spring disposed in the radial hole; a movable block disposed inside the radial trench and in contact with the spring; a refrigerant discharge hole arranged on an inner side of the radial trench; an upper cover fixed on a top of the body; a lower cover fixed at a bottom of the body having a first oblong depression with an end thereof having a first axial hole connected to the refrigerant discharge hole of the compression space; a hollow shaft having an eccentric convexity body formed in a middle thereof to be engaged with a rotary element, a first end of the hollow shaft extending into the rotary element and a second end of the hollow shaft extending into the lower room to fix the position of the hollow shaft at a middle portion of the body of the compression device to thereby rotate the rotary element eccentrically in the compression space; a first elastic oblong piece fixed in the first oblong depression with a free end elastically pressing an exit of the first axial hole and being resiliently displaceable;

a driving mechanism disposed in the lower room of the casing including a driver engaged around an end of the lower shaft and a driven element engaged around the second end of the hollow shaft, wherein the driven element is driven to rotate by the driver;

a top cover arranged on a top of the casing to seal the first and the second rooms with an entry hole and an exit hole arranged on the top cover, a set of electrical connectors arranged through the top cover and connected to the lead of the brushless DC motor within the casing;

a bottom cover arranged on a bottom of the casing to seal the lower room;

a refrigerant intake tube passing through the entry hole of the top cover to connect with the refrigerant inflow hole and the refrigerant intake hole; and a refrigerant discharge tube connected to the exit hole of the top cover;

whereby the rotor is driven by a magnetic force generated by the stator, and refrigerant flows into the compression space through the refrigerant inflow hole and the refrigerant intake hole via the refrigerant intake tube, the rotor thereby drives the driver and the driven element of the driving mechanism to rotate the rotary element eccentrically to force the refrigerant in the compression space to flow out via the refrigerant discharge hole and push the free end of the first elastic oblong piece with high pressure when the refrigerant flows through the first axial hole of the lower cover so that the refrigerant flows through the second tubular passage, the lower room, the first tubular passage, the axial groove, and is then discharged through an inner wall portion of the top cover to flow out through the refrigerant discharge tube.

2. The brushless DC compressor as claimed in claim 1, wherein the driver of the driving mechanism is a driving gear and the driven element of the driving mechanism is a driven gear, each of the driving gear and the driven gear having a plurality of cogs, the cogs of the driving gear being less than the cogs of the driven gear.

3. The brushless DC compressor as claimed in claim 2, wherein a set of speed-change gears is arranged between the driving gear and the driven gear, the set including a first speed-change gear and a second speed-change gear, each of the first and second speed-change gears having a plurality of cogs, the number of cogs of the first speed-change gear being more than the number of cogs of the second speed-change gear, the first speed-change gear meshing with the driving gear and the second speed-change gear meshing with the driven gear.

4. The brushless DC compressor as claimed in claim 3, wherein the driving gear, the driven gear, the first speed-change gear, and the second speed-change gear are helical gears.

5. The brushless DC compressor as claimed in claim 1, wherein the hollow shaft has a plurality of radially-arranged holes therein and a helical element arranged in the hollow shaft.

6. The brushless DC compressor as claimed in claim 1, wherein the first elastic oblong piece has an inner end thereof fixed with an end of a first fixed oblong piece by a screw, to thereby define a space for the free end of the first elastic oblong piece to resiliently displace.

7. The brushless DC compressor as claimed in claim 1, wherein the body further has an axially through bypass hole arranged thereon, a second oblong depression arranged on the upper cover with an end having a through second axial hole connecting the refrigerant discharge hole of the compression space, a second elastic oblong piece and a second fixed oblong piece with an inner end of both being fixed in the second oblong depression by a screw and a free end of the second elastic oblong piece pressing the second axial hole to resiliently displace; a fixing cover fixed above the upper cover, allowing the refrigerant discharged from the second axial hole to flow through the bypass hole of the body and then flow into the lower room.

8. The brushless DC compressor as claimed in claim 1, further comprising a housing for positioning the brushless DC compressor, a lid arranged on a top of the housing with an electrode connected to at least one of the set of electrical connectors on the top cover, and two openings for the refrigerant intake tube and the refrigerant discharge tube to extend from the lid; and the housing having a liquid and a water-absorbing buffer disposed in the liquid to thereby define a sealed brushless DC compressor.

9. The brushless DC compressor as claimed in claim 8, wherein the housing further includes a base arranged at a bottom thereof and a plurality of buffer cushions arranged on the base.

* * * * *